US011600913B2

(12) United States Patent
Kim et al.

(10) Patent No.: US 11,600,913 B2
(45) Date of Patent: Mar. 7, 2023

(54) ANTENNA BOARD

(71) Applicant: SAMSUNG ELECTRO-MECHANICS CO., LTD., Suwon-si (KR)

(72) Inventors: Ju Ho Kim, Suwon-si (KR); Chan Jin Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 167 days.

(21) Appl. No.: 17/182,671

(22) Filed: Feb. 23, 2021

(65) Prior Publication Data

US 2022/0209397 A1 Jun. 30, 2022

(30) Foreign Application Priority Data

Dec. 30, 2020 (KR) ..... 10-2020-0187396

(51) Int. Cl.

| | |
|---|---|
| ***H01Q 1/38*** | (2006.01) |
| ***H01Q 5/335*** | (2015.01) |
| ***H01Q 9/04*** | (2006.01) |
| ***H01Q 1/24*** | (2006.01) |

(52) U.S. Cl.

CPC ..... *H01Q 1/38* (2013.01); *H01Q 1/243* (2013.01); *H01Q 5/335* (2015.01); *H01Q 9/0407* (2013.01)

(58) Field of Classification Search

CPC ..... H01Q 1/38; H01Q 1/243; H01Q 5/335; H01Q 9/0407; H01Q 1/2283; H01Q 21/28; H01Q 9/0414; H05K 1/0298; H05K 1/03; H05K 1/16; H05K 1/18

See application file for complete search history.

(56) References Cited

U.S. PATENT DOCUMENTS

| | | | | |
|---|---|---|---|---|
| 2019/0027804 | A1* | 1/2019 | Kim | H01L 24/20 |
| 2019/0051989 | A1 | 2/2019 | Kim et al. | |
| 2019/0221917 | A1* | 7/2019 | Kim | H01Q 1/2283 |
| 2020/0259267 | A1* | 8/2020 | Park | H01Q 21/0025 |
| 2020/0335860 | A1* | 10/2020 | Hasegawa | H01Q 1/40 |
| 2021/0066814 | A1* | 3/2021 | Kim | H01Q 21/065 |
| 2021/0175609 | A1* | 6/2021 | Ryoo | H01Q 1/2283 |
| 2021/0320416 | A1* | 10/2021 | Cho | H01Q 21/065 |

FOREIGN PATENT DOCUMENTS

| | | |
|---|---|---|
| JP | 4905231 B2 | 3/2012 |
| KR | 10-2019951 B1 | 9/2019 |

* cited by examiner

*Primary Examiner* — David E Lotter

(74) *Attorney, Agent, or Firm* — Morgan, Lewis & Bockius LLP

(57) ABSTRACT

An antenna board includes a first base board unit including a first insulating layer having a first receiving groove; a first antenna board unit disposed in the first receiving groove, including a second insulating layer and a third insulating layer disposed on the second insulating layer, and further including at least one of a first patch pattern disposed on the second insulating layer and covered by the third insulating layer and a second patch pattern disposed on the third insulating layer; and a first encapsulant covering at least a portion of the first antenna board unit and filling at least a portion of the first receiving groove, wherein a dielectric constant of the second insulating layer is different from a dielectric constant of the third insulating layer.

17 Claims, 8 Drawing Sheets

ANTENNA BOARD

CROSS-REFERENCE TO RELATED APPLICATION(S)

This application claims the benefit of priority to Korean Patent Application No. 10-2020-0187396 filed on Dec. 30, 2020 in the Korean Intellectual Property Office, the disclosure of which is incorporated herein by reference in its entirety.

TECHNICAL FIELD

The present disclosure relates to an antenna board.

BACKGROUND

Recently, as fifth generation (5G) communications are applied to mobile devices such as mobile phones, an antenna module for high frequency communications of 20 GHz or higher has been used. To additionally mount a 5G antenna module in the mobile phone, it may be necessary to reduce a size and thickness of the antenna module.

To reduce the size and thickness of the antenna module, an antenna board may be implemented using an insulating material having a high dielectric constant (Dk). However, when only an insulating material having a high dielectric constant is used, problems related to performance of an antenna, such as surface waves or a narrow bandwidth, may occur.

SUMMARY

An aspect of the present disclosure is to provide an antenna board which may have a reduced size and thickness.

Another aspect of the present disclosure is to provide an antenna board which may assure performance of an antenna.

According to an example embodiment of the present disclosure, by providing an antenna board including an insulating layer having a high dielectric constant and an insulating layer having a low dielectric constant, the antenna board may have a reduced size and thickness while performance of an antenna is maintained.

According to an example embodiment of the present disclosure, an antenna board includes a first base board unit including a first insulating layer having a first receiving groove; a first antenna board unit disposed in the first receiving groove, including a second insulating layer and a third insulating layer disposed on the second insulating layer, and further including at least one of a first patch pattern disposed on the second insulating layer and covered by the third insulating layer and a second patch pattern disposed on the third insulating layer; and a first encapsulant covering at least a portion of the first antenna board unit and filling at least a portion of the first receiving groove, wherein a dielectric constant of the second insulating layer is different from a dielectric constant of the third insulating layer.

According to another example embodiment of the present disclosure, an antenna board includes a base board unit including a first insulating layer and a plurality of second insulating layers disposed on the first insulating layer and having receiving grooves; an antenna board unit disposed in the receiving groove and including a third insulating layer and a patch pattern disposed on the third insulating layer; and an encapsulant covering at least a portion of the antenna board unit and filling at least a portion of the receiving groove, wherein a dielectric constant of at least one of the plurality of second insulating layers is different from a dielectric constant of the first insulating layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
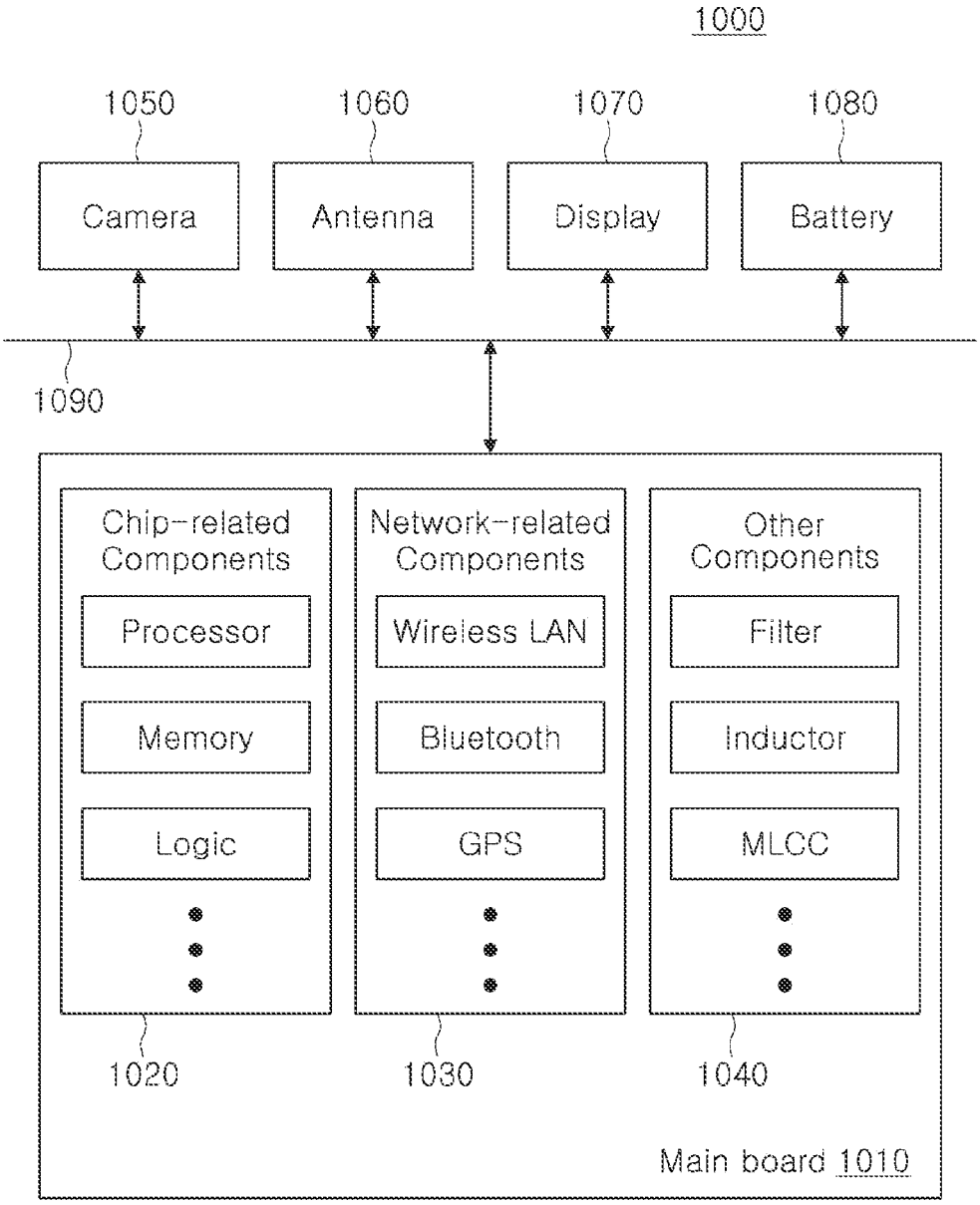
FIG. 1 is a block view illustrating an example of an electronic device system.

Hereinafter, embodiments of the present disclosure will be described as follows with reference to the attached drawings. In the drawings, shapes, sizes, and the like, of elements may be exaggerated or briefly illustrated for clarity of description.

FIG. 1 is a block view illustrating an example of an electronic device system.

Referring to FIG. 1, an electronic device 1000 may accommodate a mainboard 1010 therein. The mainboard 1010 may include chip related components 1020, network related components 1030, other components 1040, and the like, physically or electrically connected thereto. These components may be connected to others to be described below to form various signal lines 1090.

The chip related components 1020 may include a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital (ADC) converter, an application-specific integrated circuit (ASIC), or the like. However, the chip related components 1020 are not limited thereto, and may also include other types of chip related components. Also, the chip related components 1020 may be combined with each other. The chip related components 1020 may have a package form including the above-described chip or an electronic component.

The network related components 1030 may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols, designated after the abovementioned protocols. However, the network related components 1030 are not limited thereto, and may also include a variety of other wireless or wired standards or protocols. Also, the network related components 1030 may be combined with each other, together with the chip related components 1020 described above.

Other components 1040 may include a high frequency inductor, a ferrite inductor, a power inductor, ferrite beads, a low temperature co-fired ceramic (LTCC), an electromagnetic interference (EMI) filter, a multilayer ceramic capacitor (MLCC), or the like. However, other components 1040 are not limited thereto, and may also include chip-component type passive components used for various other purposes, or the like. Also, other components 1040 may be combined with the chip related components 1020 or the network related components 1030 described above.

Depending on a type of the electronic device 1000, the electronic device 1000 may include other components that may or may not be physically or electrically connected to the mainboard 1010. These other components may include, for example, a camera module 1050, an antenna 1060, a display device 1070, a battery 1080. However, an example embodiment thereof is not limited thereto, and such other components may include an audio codec, a video codec, a power amplifier, a compass, an accelerometer, a gyroscope, a speaker, a mass storage unit (for example, a hard disk drive), a compact disk (CD) drive), a digital versatile disk (DVD) drive, or the like. In addition to the above examples, other components used for various purposes depending on a type of electronic device 1000, or the like, may be included.

The electronic device 1000 may be a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like. However, the electronic device 1000 is not limited thereto, and may be any other electronic device processing data.

Figure 2:
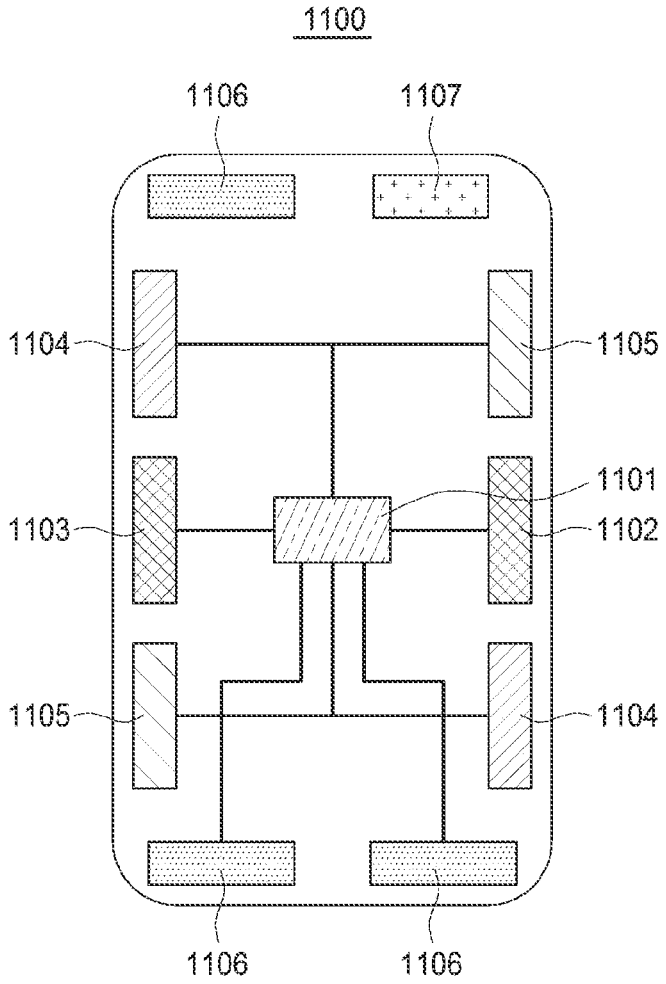
FIG. 2 is a plan view illustrating an example of an electronic device.

FIG. 2 is a perspective view illustrating an example of an electronic device.

Referring to FIG. 2, the electronic device may be implemented by a smartphone 1100. A modem 1101, and various types of antenna modules 1102, 1103, 1104, 1105, and 1106 connected to the modem 1101 through a rigid printed circuit board, a flexible printed circuit board, and/or a rigid-flexible printed circuit board may be disposed in the smartphone 1100. If desired, a Wi-Fi module 1107 may also be disposed. The antenna modules 1102, 1103, 1104, 1105, and 1106 may include antenna modules 1102, 1103, 1104, and 1105 of various frequency bands for 5G mobile communications, which are, for example, an antenna module 1102 for a 3.5 GHz band frequency, an antenna module 1103 for a 5 GHz band frequency, an antenna module 1104 for a 28 GHz band frequency, an antenna module 1105 for a 39 GHz band frequency, and the like, and may further include other antenna module 1106 for 4G. However, an example embodiment thereof is not limited thereto. The electronic device is not necessarily limited to the smartphone 1100, and may be implemented by another electronic device described above.

Antenna Board

Figure 3:
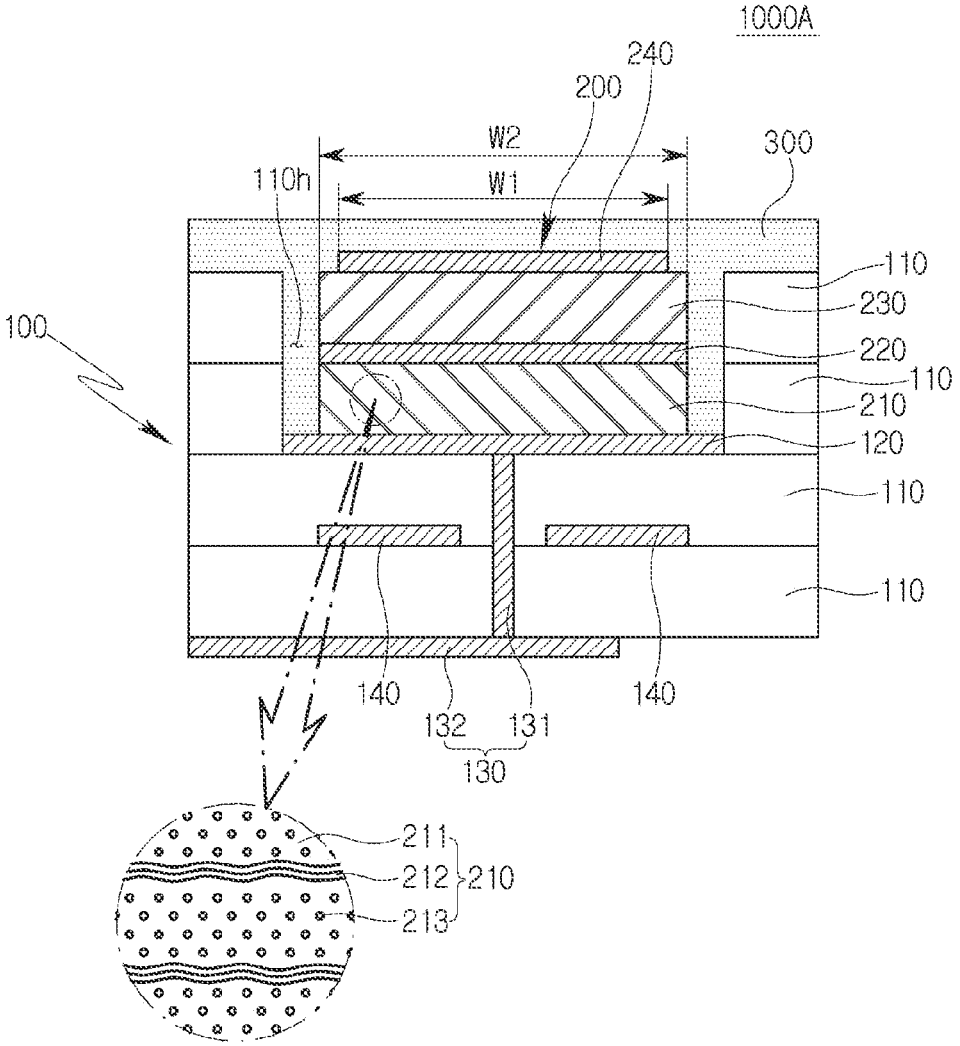
FIG. 3 is a cross-sectional view illustrating an example of an antenna board.

FIG. 3 is a cross-sectional view illustrating an example of an antenna board.

Referring to the view, an antenna board 1000A may include a base board unit 100 including a first insulating layer 110 having a receiving groove 110*h*, an antenna board unit 200 disposed in the receiving groove 110*h*, including a second insulating layer 210 and a third insulating layer 230 disposed on the second insulating layer 210 and covering a first patch pattern 220, and further including at least one of the first patch pattern 220 disposed on the second insulating layer 210 and covered by the third insulating layer 230 and a second patch pattern 240 disposed on the third insulating layer 230, and an encapsulant 300 covering at least a portion of the antenna board unit 200 and filling at least a portion of the receiving groove 110*h*.

The base board unit 100 may further include a third patch pattern 120 disposed on a bottom surface of the receiving groove 110*h*, a feed line 130 connected to the third patch pattern 120, and a ground pattern 140.

The first insulating layer 110 may include a plurality of first insulating layers 110. In this case, the receiving groove 110*h* may be formed by penetrating a portion of the plurality of first insulating layers 110.

As a material for forming the first insulating layer 110, a general insulating material formed on an insulating layer of a board may be used. For example, as a material for forming the first insulating layer 110, at least one of an epoxy resin, a bismaleimide resin, or a resin in which the above-mentioned resin is impregnated in a core material such as glass fiber (glass cloth, or glass fabric) along with an inorganic filler such as silica ($SiO_2$), such as prepreg, an Ajinomoto build-up film (ABF), FR-4, and BT (Bismaleimide Triazine) may be used. Alternatively, low temperature co-fired ceramic (LTCC), glass, or a ceramic-based insulating material may be used as a material for forming the first insulating layer 110.

The second insulating layer 210 may be formed of an insulating material having a low dielectric constant, and accordingly, a dielectric constant of the first insulating layer 110 may be equal to or higher than a dielectric constant of the second insulating layer 210. For example, a dielectric constant of the first insulating layer 110 may be in a range from 3 to 5, but an example embodiment thereof is not limited thereto.

The third patch pattern 120 may be configured as a main radiation patch pattern, or may be configured as a coupling patch pattern.

The third patch pattern 120 may be disposed on a bottom surface of the receiving groove 110*h*. By including this structure, when the receiving groove 110*h* is formed, the third patch pattern 120 may work as a processing stop layer. However, an example embodiment thereof is not limited thereto, and the third patch pattern 120 may be buried in the plurality of first insulating layers 110.

The third patch pattern 120 may be formed through a plating process generally used in a process of manufacturing a board. For example, the third patch pattern 120 may be formed by forming a first metal layer, working as a seed layer, on the first insulating layer 110 through electroless plating, and forming a second metal layer on the first metal layer through electrolytic plating. The third patch pattern 120 may be formed by printing, sputtering, or a deposition process.

The feed line 130 may be connected to the third patch pattern 120 and may supply a signal to the third patch pattern 120. The feed line 130 may also be connected to at least one of the first patch pattern 220 and the second patch pattern 240. Alternatively, the feed line 130 may be connected to at least one of the first patch pattern 220 and the second patch pattern 240 and may not be connected to the third patch pattern 120.

The feed line 130 may include a feed via 131 penetrating the first insulating layer 110 and a feed pattern 132 disposed on the first insulating layer 110.

The ground pattern 140 may electromagnetically shield the first to third patch patterns 120, 220, and 240 from the feed line 130. The ground pattern 140 may be disposed at a level between the third patch pattern 120 and the feed pattern 132, but an example embodiment thereof is not limited thereto.

A dielectric constant of the second insulating layer 210 may be different from a dielectric constant of the third insulating layer 230. For example, a difference between the dielectric constant of the second insulating layer 210 and the dielectric constant of the third insulating layer 230 may be equal to or higher than 3. Accordingly, since the antenna board unit 200 includes an insulating layer having a large dielectric constant, the antenna board 1000A may have a reduced size and thickness, and since the antenna board unit 200 includes an insulating layer having a small dielectric constant, antenna performance may be assured as well.

Specifically, the second insulating layer 210 may be formed of a material having a low dielectric constant, and the third insulating layer 230 may be formed of a material having a high dielectric constant. Accordingly, the dielectric constant of the second insulating layer 210 may be lower than the dielectric constant of the third insulating layer 230. However, if desired, the dielectric constant of the third insulating layer 230 may be lower than the dielectric constant of the second insulating layer 210.

The second insulating layer 210 may include at least one resin 211 from among epoxy, polyphenyl ether, polytetrafluoroethylene, and liquid crystal polymer in order to have a low dielectric constant. Also, the second insulating layer 210 may further include at least one of a glass fiber 212 and an inorganic filler 213 in addition to the resin 211. The inorganic filler 213 may be implemented by, for example, a glass filler, a ceramic filler, or the like. The dielectric constant of the second insulating layer 210 may be equal to or lower than 3, but an example embodiment thereof is not limited thereto.

The first patch pattern 220 may be configured as a main radiation patch pattern or a coupling patch pattern. The first patch pattern 220 may be connected to the feed line 130, and the feed via 131 may further penetrate the second insulating layer 210 and may be connected to the first patch pattern 220, for example.

The first patch pattern 220 may be formed on the second insulating layer 210 by a printing method. Alternatively, the first patch pattern 220 may be formed on the second insulating layer 210 through sputtering, deposition, plating, or the like. The first patch pattern 220 may be formed of a conductive material such as copper (Cu), aluminum (Al), silver (Ag), tin (Sn), gold (Au), nickel (Ni), lead (Pb), titanium (Ti), or alloys thereof.

The third insulating layer 230 may include low temperature co-fired ceramics (LTCC) to have a high dielectric constant. The dielectric constant of the third insulating layer 230 may be equal to or higher than 6, but an example embodiment thereof is not limited thereto.

The second patch pattern 240 may be configured as a coupling patch pattern or a main radiation patch pattern. The second patch pattern 240 may be connected to the feed line 130. For example, the feed via 131 may further penetrate the second insulating layer 210 and the third insulating layer 230 and may be connected to the second patch pattern 240.

The second patch pattern 240 may be formed on the second insulating layer 210 by a printing method. Alternatively, the second patch pattern 240 may be formed on the second insulating layer 210 through sputtering, deposition, plating, or the like. The second patch pattern 240 may be formed of a conductive material such as copper (Cu), aluminum (Al), silver (Ag), tin (Sn), gold (Au), nickel (Ni), lead (Pb), titanium (Ti), or alloys thereof. The second patch pattern 240 may be formed simultaneously with the first patch pattern 220, or the second patch pattern 240 and the first patch pattern 220 may be formed sequentially.

A maximum width w1 of the second patch pattern 240 may be equal to or less than a maximum width w2 of the first patch pattern 220. By including this structure, radio frequency (RF) properties of the antenna may improve.

The antenna board unit 200 may be separately manufactured in the form of a chip and may be disposed in the receiving groove 110*h*. For example, the antenna board 200 may be formed by forming patch patterns 220 and 240 on one or both surfaces of a first insulating board for forming the third insulating layer 230, forming, on the first insulating board, a second insulating board for forming the second insulating layer 210, and dividing the first and second insulating boards to have an individual chip shape by laser processing or mechanical processing. Accordingly, the antenna board 1000A including insulating layers having different dielectric constants may be easily implemented through a simple process.

A dielectric constant of the encapsulant 300 may be equal to or lower than the dielectric constant of the third insulating layer 230.

As a material for forming the encapsulant 300, an insulating material such as ABF may be used. If desired, a photo imageable encapsulant (PIE), an epoxy molding compound (EMC), or the like, may be used as a material for forming the encapsulant 300.

Figure 4:
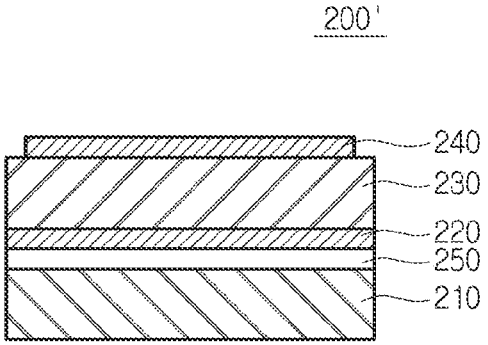
FIG. 4 is a cross-sectional view illustrating a modified example of the antenna board illustrated in FIG. 3.

FIG. 4 is a cross-sectional view illustrating a modified example of the antenna board illustrated in FIG. 3.

Referring to the drawings, an antenna board unit 200' may further include an adhesive layer 250 disposed on at least one of both surfaces of the second insulating layer 210.

For example, the adhesive layer 250 may be disposed on the surface on which the first patch pattern 220 of the second insulating layer 210 is disposed as illustrated in the view, or the adhesive layer 250 may be disposed on an opposite surface of the surface on which the first patch pattern 220 of the second insulating layer 210 is disposed as illustrated in the view.

The antenna board unit 200' may also be disposed in the receiving groove 110*h* of the antenna board 1000A illustrated in FIG. 3.

The adhesive layer 150 may be formed using a generally used adhesive material, and an adhesive tape may be used, for example. However, an example embodiment thereof is not limited thereto, and the adhesive layer 150 may be formed by coating at least one of both surfaces of the second insulating layer 210 with an adhesive resin, or the like.

Figure 5:
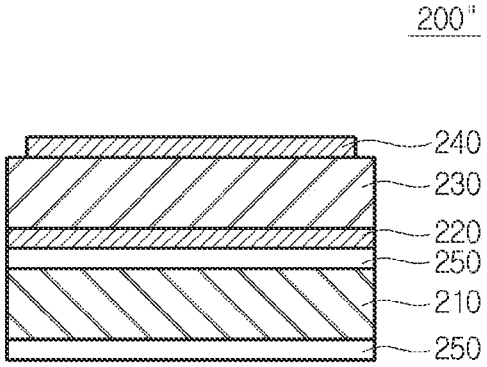
FIG. 5 is a cross-sectional view illustrating a modified example of the antenna board illustrated in FIG. 3.

FIG. 5 is a cross-sectional view illustrating a modified example of the antenna board illustrated in FIG. 3.

Referring to the drawings, the antenna board unit 200" may further include an adhesive layer 250 disposed on both surfaces of the second insulating layer 210.

The antenna board unit 200" may also be disposed in the receiving groove 110*h* of the antenna board 1000A in FIG. 3.

Figure 6:
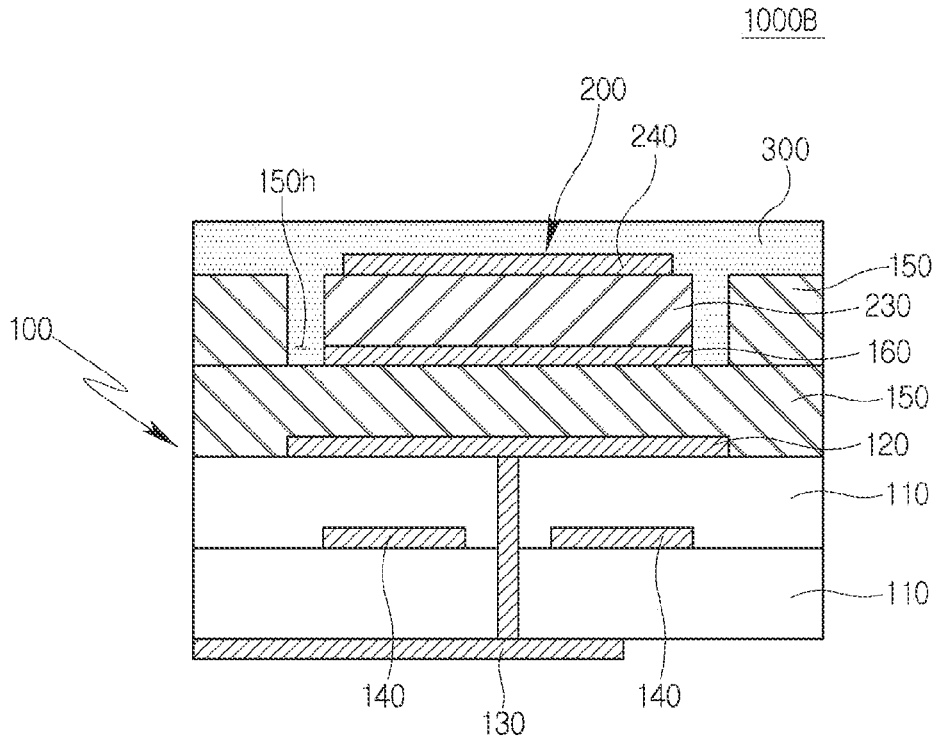
FIG. 6 is a cross-sectional view illustrating another example of an antenna board.

FIG. 6 is a cross sectional view illustrating another example of an antenna board.

Referring to the view, in an antenna board 1000B, unlike the antenna board of FIG. 3, the antenna board unit 200 in FIG. 6 does not include the second insulating layer 210 and the first patch pattern 220. Instead, the base board unit 100 may include a second insulating layer 150 and a first patch pattern 160 which may correspond to the second insulating layer 210 and the first patch pattern 220 in FIG. 3.

The second insulating layer 150 and the first patch pattern 160 may be formed on the base board unit 100 in advance, and the antenna board unit 200 including the third insulating layer 230 and the second patch pattern 240 may be separately formed, thereby implementing the structure of the antenna board 1000B.

The second insulating layer 150 may have a receiving groove 150*h*. The second insulating layer 150 may include a plurality of second insulating layers 150, and the receiving groove 150*h* may be formed by penetrating a portion of the plurality of second insulating layers 150. The antenna board unit 200 may be disposed in the receiving groove 150*h*.

The first patch pattern 160 may be disposed on a bottom surface of the receiving groove 150*h*. By including this structure, when the receiving groove 150*h* is formed, the first patch pattern 160 may work as a processing stop layer. However, an example embodiment thereof is not limited thereto, and the first patch pattern 160 may be buried in the plurality of second insulating layers 150. In example embodiments, the antenna board 1000B may not include the first patch pattern 160.

A dielectric constant of at least one of the plurality of second insulating layers 150 may be different from a dielectric constant of the first insulating layer 110. For example, as described above, the second insulating layer 210 may be formed of an insulating material having a low dielectric constant, and thus, a dielectric constant of at least one of the plurality of second insulating layers 150 may be lower than a dielectric constant of the first insulating layer 110.

Similarly, a dielectric constant of the third insulating layer 230 may be different from the dielectric constant of at least one of the plurality of second insulating layers 150. For example, as described above, the second insulating layer 210 may be formed of an insulating material having a low dielectric constant, and thus, the dielectric constant of the third insulating layer 230 may be higher than the dielectric constant of at least one of the plurality of second insulating layers 150.

Figure 7:
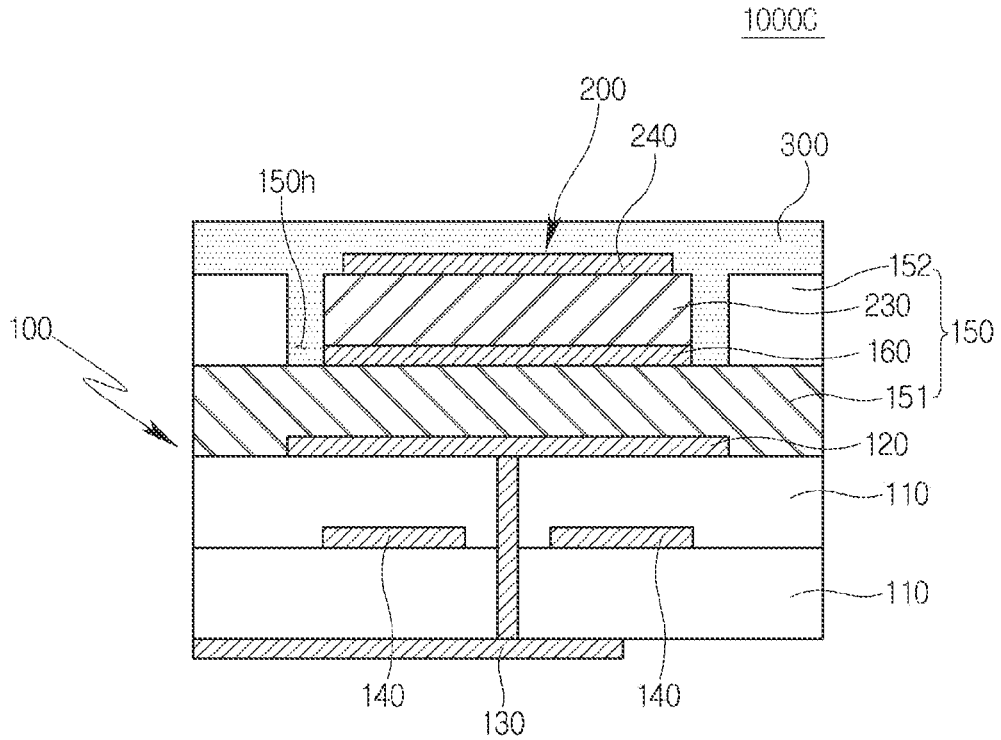
FIG. 7 is a cross-sectional view illustrating another example of an antenna board.

FIG. 7 is a cross-sectional view illustrating another example of an antenna board.

Referring to the drawings, the antenna board 1000D may include a plurality of second insulating layers 151 and 152, and dielectric constants of the plurality of second insulating layers 151 and 152 may be different from each other.

At least the second insulating layer 151 of the plurality of second insulating layers 151 and 152 may be formed of an insulating material having a low dielectric constant, and a second insulating layer 151 having a low dielectric constant may be configured as a second insulating layer 151 disposed on a lower side of the antenna board unit 200.

A dielectric constant of the second insulating layer 152 other than the second insulating layer 151 having a low dielectric constant is not limited to any particular example, and may be, for example, equal to the dielectric constant of the first insulating layer 110, but an example embodiment thereof is limited thereto.

Figure 8:
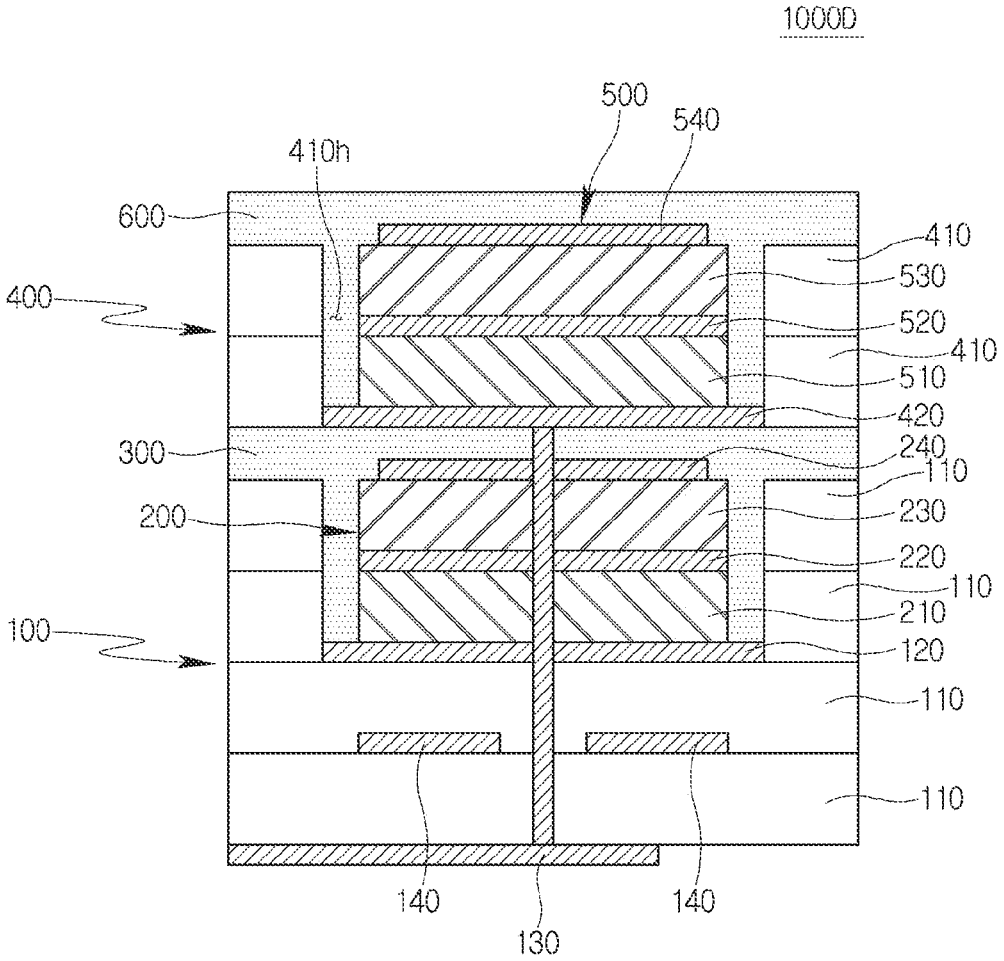
FIG. 8 is a cross-sectional view illustrating another example of an antenna board.

FIG. 8 is a cross-sectional view illustrating another example of an antenna board.

Referring to the view, an antenna board 1000D may include a plurality of base board units 100 and 400, a plurality of antenna board units 200 and 500, and a plurality of encapsulants 300 and 600.

Specifically, differently from the antenna board 1000A, the antenna board 1000D may include the base board unit 400 disposed on the encapsulant 300 and including a fourth insulating layer 410 having an receiving groove 410*h*, the antenna board unit 500 disposed in the receiving groove 410*h*, including a fifth insulating layer 510 and a sixth insulating layer 530 disposed on the fifth insulating layer 510, and further including at least one of a fourth patch pattern 520 disposed on the fifth insulating layer 510 and covered by the sixth insulating layer 530 and a fifth patch pattern 540 disposed on the sixth insulating layer, and the encapsulant 600 covering at least a portion of the antenna board unit 500 and filling at least a portion of the receiving groove 410*h*. A sixth patch pattern 420 may be disposed on a bottom surface of the receiving groove 410*h*.

The other descriptions of the base board unit 400, the antenna board unit 500, the encapsulant 600, and the elements included therein may be the same as the descriptions of the base board unit 100, the antenna board unit 200, the encapsulant 300, and the elements included therein, and thus, detailed descriptions thereof will not be repeated. For example, a dielectric constant of the fifth insulating layer 510 may be different from a dielectric constant of the sixth insulating layer 530.

The plurality of antenna board units 200 and 500 included in the antenna board 1000D may have different bandwidths, and accordingly, the antenna board 1000D may respond to a wider bandwidth.

Antenna Module

Figure 9:
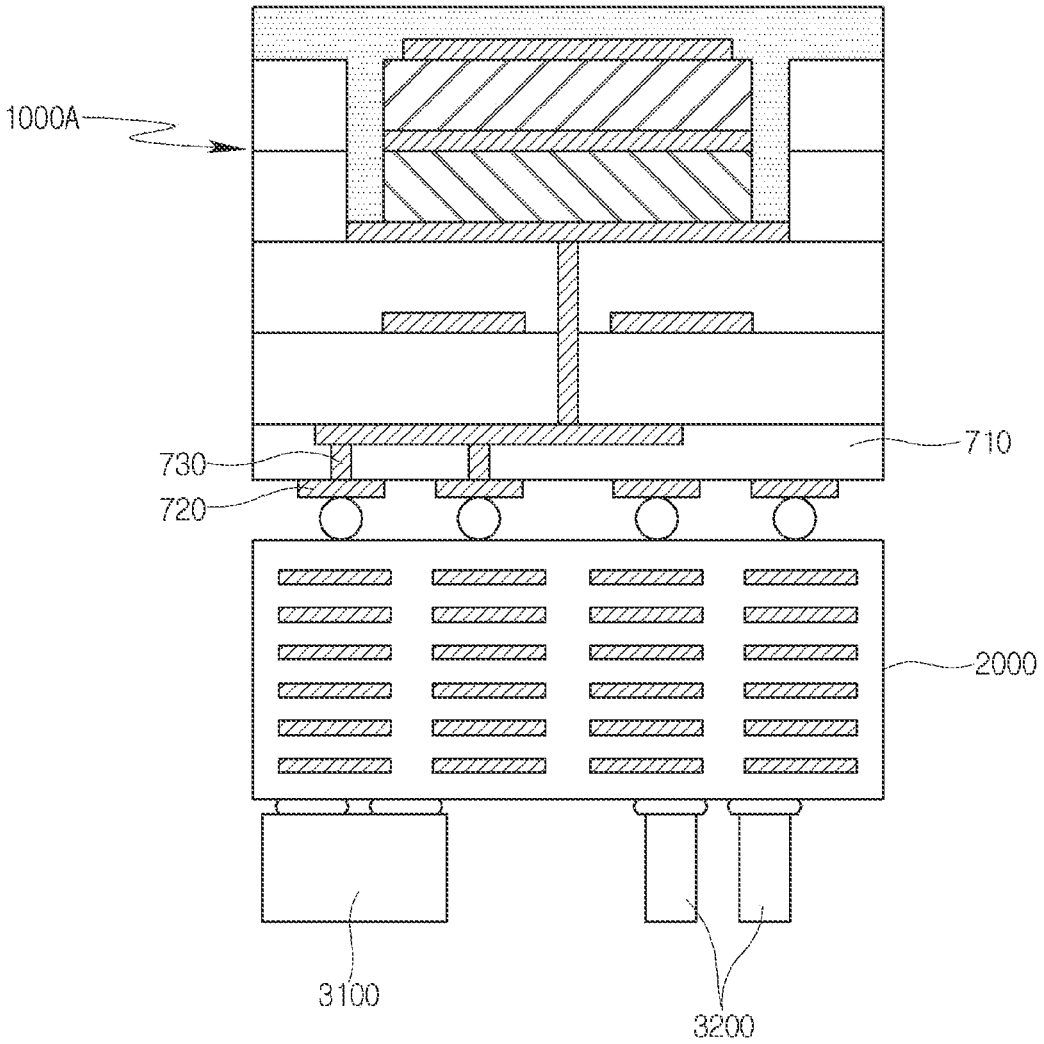
FIG. 9 is a cross-sectional view illustrating an example of an antenna module including an antenna board.

FIG. 9 is a cross-sectional view illustrating an example of an antenna module including an antenna board.

The antenna module 2000A may include an antenna board 1000A, a connection board 2000 disposed on the antenna board 1000A, and electronic components 3100 and 3200 mounted on the connection board 2000.

The antenna board 1000A may further include an internal wiring layer (not illustrated), an insulating member 710 disposed on a feed line, an external wiring layer 720 disposed on the insulating member 710, and a via 730 penetrating the insulating member 710 and connecting the internal wiring layer (not illustrated) to the external wiring layer 720.

The electronic components 3100 and 3200 may include an active component 3100 and/or a passive component 3200. The active component 3100 may include at least one of a radio frequency integrated circuit (RFIC) generating an RF signal and a power management integrated circuit (PMIC) generating power. The passive component 3200 may be implemented by an inductor or a capacitor, but an example embodiment thereof is not limited thereto.

Figure 10:
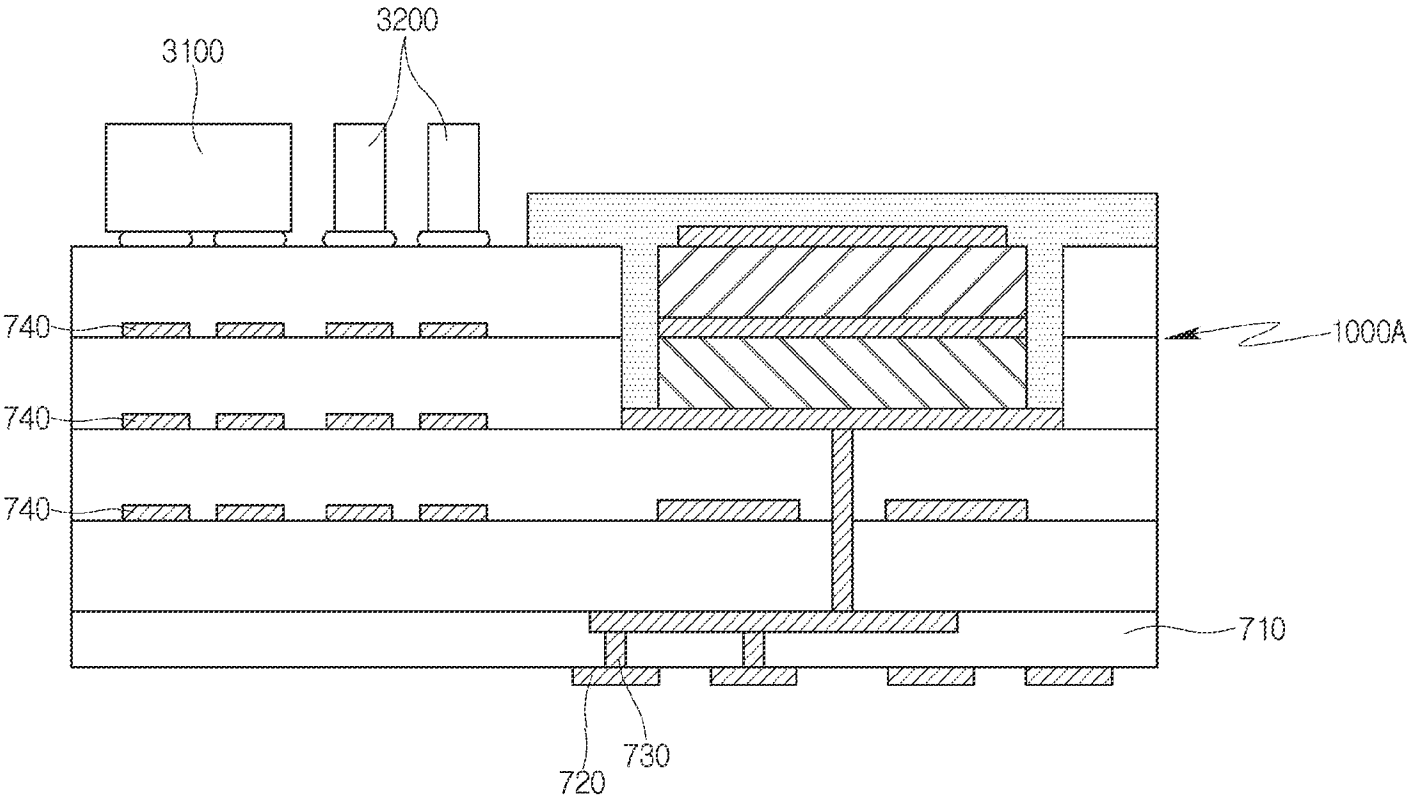
FIG. 10 is a cross-sectional view illustrating another example of an antenna module including an antenna board.

FIG. 10 is a cross-sectional view illustrating another example of an antenna module including an antenna board.

Differently from the antenna module 2000A, in the antenna module 2000B, the electronic components 3100 and 3200 may be disposed on the antenna board 1000A without the connection board 2000.

Also, the antenna board 1000A may include at least one internal wiring layer 740 buried in the board, and the electronic components 3100 and 3200 may be connected to the internal wiring layer 740.

According to the aforementioned example embodiments, an antenna board which may have a reduced size and thickness may be provided.

Also, an antenna board which may assure performance of an antenna may be provided.

In the example embodiment, the expression that an element is "disposed" on another element is not intended to set a direction. Accordingly, the expression that an element is "disposed" on another element may indicate that the element is disposed on an upper side of another element or on a lower side.

In the example embodiments, the term "connected" may not only refer to "directly connected" but may also include "indirectly connected" by means of an adhesive layer, or the like. Also, the term "electrically connected" may include both the case in which elements are "physically connected" and the case in which elements are "not physically connected."

The terms "first," "second," and the like may be used to distinguish one element from the other, and may not limit a sequence and/or an importance, or others, in relation to the elements. In some cases, a first element may be referred to as a second element, and similarly, a second element may be referred to as a first element without departing from the scope of right of the example embodiments.

In the example embodiments, the term "example embodiment" may not refer to one same example embodiment, and may be provided to describe and emphasize different unique features of each example embodiment. The above suggested example embodiments may be implemented do not exclude the possibilities of combination with features of other example embodiments. For example, even though the features described in one example embodiment are not described in the other example embodiment, the description may be understood as relevant to the other example embodiment unless otherwise indicated.

An expression used in the singular encompasses the expression of the plural, unless it has a clearly different meaning in the context.

While the example embodiments have been illustrated and described above, it will be apparent to those skilled in the art that modifications and variations could be made without departing from the scope of the present invention as defined by the appended claims.

What is claimed is:

1. An antenna board, comprising:

a first base board unit including a first insulating layer having a first receiving groove;

a first antenna board unit disposed in the first receiving groove, including a second insulating layer and a third insulating layer disposed on the second insulating layer, and further including at least one of a first patch pattern disposed on the second insulating layer and covered by the third insulating layer and a second patch pattern disposed on the third insulating layer; and a first encapsulant covering at least a portion of the first antenna board unit and filling at least a portion of the first receiving groove, wherein a dielectric constant of the second insulating layer is different from a dielectric constant of the third insulating layer, and wherein the first base board unit further includes a third patch pattern disposed on a bottom surface of the first receiving groove, and a feedline connected to the third patch pattern, and a ground pattern.

2. The antenna board of claim 1, wherein the dielectric constant of the second insulating layer is lower than the dielectric constant of the third insulating layer.

3. The antenna board of claim 1, wherein a dielectric constant of the first encapsulant is equal to or lower than the dielectric constant of the third insulating layer.

4. The antenna board of claim 1, wherein a dielectric constant of the first insulating layer is higher than the dielectric constant of the second insulating layer.

5. The antenna board of claim 1, wherein a maximum width of the second patch pattern is equal to or less than a maximum width of the first patch pattern.

6. The antenna board of claim 1, wherein the first antenna board unit further includes an adhesive layer disposed on at least one of both surfaces of the second insulating layer.

7. The antenna board of claim 1, wherein the second insulating layer includes at least one of epoxy, polyphenylether, polytetrafluoroethylene, and a liquid crystal polymer.

8. The antenna board of claim 7, wherein the second insulating layer further includes at least one of glass fiber and an inorganic filler.

9. An antenna board, comprising:

a first base board unit including a first insulting layer having a first receiving groove;

a first antenna board unit disposed in the first receiving groove, including a second insulating layer and a third insulating layer disposed on the second insulating layer, and further including at least one of a first patch pattern disposed on the second insulating layer and covered by the third insulating layer and a second patch pattern disposed on the third insulating layer;

a first encapsulant covering at least a portion of the first antenna board unit and filling at least a portion of the first receiving groove;

a second base board unit disposed on the first encapsulant and including a fourth insulating layer having a second receiving groove;

a second antenna board unit disposed in the second receiving groove, including a fifth insulating layer and a sixth insulating layer disposed on the fifth insulating layer, and further including at least one of a third patch pattern disposed on the fifth insulating layer and covered by the sixth insulating layer and a fourth patch pattern disposed on the sixth insulating layer; and a second encapsulant covering at least a portion of the second antenna board unit and filling at least a portion of the second receiving groove, wherein a dielectric constant of the second insulating layer is different from a dielectric constant of the third insulating layer, and wherein a dielectric constant of the fifth insulating layer is different from a dielectric constant of the sixth insulating layer.

10. An antenna board, comprising:

a base board unit including a first insulating layer and a plurality of second insulating layers disposed on the first insulating layer, the plurality of second insulating layers having a receiving groove penetrating a portion of the plurality of second insulating layers;

an antenna board unit disposed in the receiving groove and including a first patch pattern disposed on a bottom surface of the receiving groove, a third insulating layer disposed on the first patch pattern and a second patch pattern disposed on the third insulating layer; and an encapsulant covering at least a portion of the antenna board unit and filling at least a portion of the receiving groove, wherein a dielectric constant of at least one of the plurality of second insulating layers is different from a dielectric constant of the first insulating layer.

11. The antenna board of claim 10, wherein the dielectric constant of at least one of the plurality of second insulating layers is lower than the dielectric constant of the first insulating layer.

12. The antenna board of claim 10, wherein a dielectric constant of the third insulating layer is higher than the dielectric constant of at least one of the plurality of second insulating layers.

13. An antenna board, comprising:

a first insulating layer having a receiving groove in a first surface thereof;

a first patch pattern disposed between a second insulating layer and a third insulating layer, the second insulating layer being disposed in the first receiving groove;

a second patch pattern disposed on the first insulating layer;

a third patch pattern disposed in the receiving groove on the first surface such that the third patch pattern is disposed between the first insulating layer and the second insulating layer; and a feed line connected to the third patch pattern, wherein dielectric constant of the second insulating layer is lower than that of both the first insulating layer and the third insulating layer.

14. The antenna board of claim 13, further comprising a first encapsulant filling at least a portion of the receiving groove, the first encapsulant having a dielectric constant lower than or equal to that of the third insulating layer.

15. The antenna board of claim 13, wherein a maximum width of the second patch pattern is less than or equal to a maximum width of the first patch pattern.

16. The antenna board of claim 13, wherein the second insulating layer includes at least one of epoxy, polyphenylether, polytetrafluoroethylene, and a liquid crystal polymer.

17. The antenna board of claim 13, further comprising an adhesive layer disposed on one or both surfaces of the second insulating layer.

* * * * *